US011401839B2

(12) United States Patent
Sarati

(10) Patent No.: US 11,401,839 B2
(45) Date of Patent: Aug. 2, 2022

(54) ROCKER BASED BLEEDER ENGINE BRAKE

(71) Applicant: Eaton Intelligent Power Limited, Dublin (IE)

(72) Inventor: Venkata Sarati, Pune (IN)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/146,784

(22) Filed: Jan. 12, 2021

(65) Prior Publication Data

US 2021/0131315 A1 May 6, 2021

Related U.S. Application Data

(63) Continuation of application No. PCT/US2019/041620, filed on Jul. 12, 2019.

(30) Foreign Application Priority Data

Jul. 13, 2018 (IN) ..... 201811026226

(51) Int. Cl.
*F01L 1/18* (2006.01)
*F01L 1/047* (2006.01)
(Continued)

(52) U.S. Cl.
CPC ..... *F01L 1/181* (2013.01); *F01L 1/047* (2013.01); *F01L 1/146* (2013.01); *F01L 1/24* (2013.01); *F01L 1/2411* (2013.01); *F01L 13/06* (2013.01); *F01L 2001/054* (2013.01); *F01L 2001/2427* (2013.01); *F01L 2001/2444* (2013.01); *F01L 2001/256* (2013.01); *F01N 2260/14* (2013.01)

(58) Field of Classification Search
CPC ..... F01L 2001/054; F01L 1/146; F01L 1/181; F01L 1/2411; F01L 2001/2427; F01L 2001/2444; F01L 2001/256; F01L 13/06; F01L 2260/14
USPC ..... 123/90.46, 90.55, 90.61; 60/324
See application file for complete search history.

(56) References Cited

U.S. PATENT DOCUMENTS 6,253,730 B1 * 7/2001 Gustafson ..... F01L 9/10 123/321
6,450,144 B2 * 9/2002 Janak ..... F01L 13/065 123/321

(Continued)

OTHER PUBLICATIONS

International Search Report and Written Opinion for International Application No. PCT/US2019/041620 dated Oct. 31, 2019.

*Primary Examiner* — Jorge L Leon, Jr.
(74) *Attorney, Agent, or Firm* — RMCK Law Group PLC

(57) ABSTRACT

An exhaust valve rocker arm assembly operable in an engine braking mode includes a rocker arm configured to rotate about a rocker shaft defining a pressurized fluid supply conduit, the rocker arm having a fluid supply passage defined therein. An engine brake capsule is disposed in the rocker arm and in fluid communication with the fluid supply passage. The engine brake capsule is configured to selectively move from a retracted position to an extended position where the engine brake capsule engages and partially opens an exhaust valve to perform a bleeder brake operation. A reset pin assembly is configured to selectively drain fluid from the engine brake capsule.

18 Claims, 4 Drawing Sheets

(51) Int. Cl.

| | |
|---|---|
| ***F01L 1/14*** | (2006.01) |
| ***F01L 1/24*** | (2006.01) |
| ***F01L 13/06*** | (2006.01) |
| *F01L 1/245* | (2006.01) |

(56) References Cited

U.S. PATENT DOCUMENTS

| | | | | |
|---|---|---|---|---|
| 6,691,674 | B2 | 2/2004 | McCarthy et al. | |
| 7,617,807 | B2 | 11/2009 | Diggs et al. | |
| 9,885,263 | B2 | 2/2018 | Meneely et al. | |
| 2004/0231639 | A1* | 11/2004 | Israel | F02D 13/04 123/321 |
| 2005/0087170 | A1* | 4/2005 | Rammer | F01L 13/065 123/321 |
| 2010/0101531 | A1 | 4/2010 | Carlström et al. | |
| 2010/0170472 | A1* | 7/2010 | Yang | F01L 13/065 123/321 |
| 2013/0042835 | A1* | 2/2013 | Hansson | F01L 13/06 123/321 |
| 2014/0130774 | A1* | 5/2014 | Le Forestier | F02D 9/06 123/321 |
| 2014/0182536 | A1* | 7/2014 | Yang | F01L 1/181 123/90.39 |
| 2015/0144096 | A1* | 5/2015 | Meneely | F01L 13/06 123/321 |
| 2015/0252694 | A1* | 9/2015 | Gustafson | F02D 13/04 123/321 |
| 2016/0146074 | A1* | 5/2016 | Lynch | F01L 1/24 123/90.11 |
| 2016/0319708 | A1* | 11/2016 | Nielsen | F01L 1/14 |

* cited by examiner

ROCKER BASED BLEEDER ENGINE BRAKE

CROSS-REFERENCE TO RELATED APPLICATIONS

This application is a continuation of International Application No. PCT/US2019/041620 filed Jul. 12, 2019, which claims the benefit of Indian Provisional Application No. 201811026226 filed on Jul. 13, 2018, the contents of which are incorporated herein in their entirety by reference thereto.

FIELD

The present disclosure relates generally to a rocker arm assembly for a valvetrain assembly and, more particularly, to a rocker arm assembly having a rocker arm that incorporates a bleeder brake capsule.

BACKGROUND

Engine braking can be used to retard forces within an engine to ultimately slow a vehicle down. In one typical valvetrain assembly used with an engine brake, an exhaust valve is actuated by a rocker arm which engages the exhaust valve by means of a valve bridge. The rocker arm rocks in response to a cam on a rotating camshaft and presses down on the valve bridge which itself presses down on the exhaust valve to open it.

One form of engine braking includes a bleeder brake. Bleeder brakes can be used as auxiliary brakes, in addition to wheel brakes, on relatively large vehicles, for example trucks, powered by heavy or medium duty diesel engines. A bleeder brake typically includes a piston that selectively extends to a full stroke. In the full stroke, the piston can maintain an exhaust valve open a fixed amount throughout an engine cycle. As a result, a mechanical gap can be generated in the valvetrain. In many instances, such a gap can be incompatible with a common hydraulic lash adjuster (HLA). An HLA may also be provided in the valvetrain assembly to remove any lash or gap that develops between the components in the valvetrain assembly. The mechanical gap can allow the HLA to unfavorably pump-up preventing the exhaust valves to close once the bleeder brake is deactivated. When the exhaust valves are not seated, the valve will transmit the combustion pressure of the valvetrain with detrimental effect of the valvetrain components. In extreme conditions, the air in the cylinder will be prevented from reaching proper compression pressure necessary for combustion.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

According to various aspects of the present disclosure, an exhaust valve rocker arm assembly operable in an engine braking mode is provided. In one example, the assembly includes a rocker arm configured to rotate about a rocker shaft defining a pressurized fluid supply conduit, the rocker arm having a fluid supply passage defined therein. An engine brake capsule is disposed in the rocker arm and in fluid communication with the fluid supply passage. The engine brake capsule is configured to selectively move from a retracted position to an extended position where the engine brake capsule engages and partially opens an exhaust valve to perform a bleeder brake operation. A reset pin assembly is configured to selectively drain fluid from the engine brake capsule.

In addition to the foregoing, the described exhaust valve rocker arm assembly may include one or more of the following features: wherein the reset pin assembly includes a pin slidingly disposed within the rocker arm; wherein the reset pin is disposed within a bore formed in the rocker arm and the reset pin is disposed transverse to an extension of the rocker arm; wherein the reset pin assembly further includes a biasing mechanism configured to bias the reset pin into a closed position such that the reset pin acts as a spool valve and blocks a fluid outlet conduit formed in the rocker arm; and wherein the rocker arm further includes a fluid outlet conduit in fluid communication with the engine brake capsule and configured to drain fluid from the engine brake capsule via the reset pin assembly.

In addition to the foregoing, the described exhaust valve rocker arm assembly may include one or more of the following features: wherein the engine brake capsule includes a plunger slidingly disposed within the rocker arm; wherein the engine brake capsule includes a check ball assembly; and wherein the check ball assembly comprises a check ball, a first biasing mechanism configured to bias the check ball into a sealing position to seal the fluid supply passage, and a second biasing mechanism configured to bias a plunger into a retracted position within a bore defined in the rocker arm.

In addition to the foregoing, the described exhaust valve rocker arm assembly may include one or more of the following features: a fixed pedestal configured to be selectively engaged by the reset pin assembly to thereby actuate the reset pin assembly and facilitate draining the fluid from the engine brake capsule; a controller configured to generate a backpressure inside an exhaust manifold to reopen the exhaust valve; and wherein the controller is configured to generate the backpressure by closing at least one of a butterfly valve and a variable geometry turbocharger.

In another aspect, a valvetrain assembly is provided. In one example, the valvetrain assembly includes a rocker housing including a fixed shoulder, a rocker shaft received within the rocker housing, a rocker arm assembly configured to rotate about the rocker shaft, and a pushrod configured to selectively engage and rotate the rocker arm assembly about the rocker shaft to engage and open an exhaust valve. The rocker arm assembly includes a rocker arm having a fluid supply passage defined therein, an engine brake capsule disposed in the rocker arm and in fluid communication with the fluid supply passage, the engine brake capsule configured to selectively move from a retracted position to an extended position where the engine brake capsule engages and partially opens the exhaust valve to perform a bleeder brake operation, and a reset pin assembly configured to selectively engage the fixed shoulder to drain fluid from the engine brake capsule.

In addition to the foregoing, the described valvetrain assembly may include one or more of the following features: a camshaft having a lift profile configured to engage and cause upward movement of the pushrod; a hydraulic lash adjuster lifter implemented between the camshaft and the pushrod; wherein the rocker arm further includes a fluid outlet conduit in fluid communication with the engine brake capsule and configured to drain fluid from the engine brake capsule via the reset pin assembly; wherein the reset pin assembly comprises a pin slidingly disposed within a transverse bore formed in the rocker arm, and a biasing mechanism configured to bias the reset pin into a closed position such that the reset pin acts as a spool valve and blocks a fluid outlet conduit formed in the rocker arm; and wherein the engine brake capsule includes a plunger slidingly disposed within the rocker arm, and a check ball assembly having a check ball, a first biasing mechanism configured to bias the check ball into a sealing position to seal the fluid supply passage, and a second biasing mechanism configured to bias a plunger into a retracted position within a bore defined in the rocker arm.

In yet another aspect, a method of operating a valvetrain assembly having an exhaust rocker arm assembly comprising a rocker arm configured to rotate about a rocker shaft defining a pressurized fluid supply conduit, the rocker arm having a fluid supply passage defined therein, an engine brake capsule disposed in the rocker arm and in fluid communication with the fluid supply passage, the engine brake capsule configured to selectively move from a retracted position to an extended position where the engine brake capsule engages and partially opens an exhaust valve to perform a bleeder brake operation, and a reset pin assembly configured to selectively drain fluid from the engine brake capsule is provided. In one example, the method includes activating an engine braking mode by closing one of a butterfly valve and a variable geometry turbocharger to generate backpressure inside an exhaust manifold, opening the exhaust valve with the generated backpressure along with low in-cylinder pressure, supplying pressurized fluid via the fluid supply conduit and the fluid supply passage to the engine brake capsule to thereby expand the brake capsule into the extended position, and maintaining the exhaust valve partially open for a predetermined time via the engine brake capsule in the extended position.

In addition to the foregoing, the described method may include one or more of the following features: wherein the step of maintaining the exhaust valve partially open comprises performing a full-cycle bleeder brake operation; and engaging the reset pin assembly with a pedestal of the valvetrain assembly to thereby drain fluid from the engine brake capsule and reset the engine brake capsule to the retracted position.

BRIEF DESCRIPTION OF THE DRAWINGS

The present disclosure will become more fully understood from the detailed description and the accompanying drawings, wherein.

DETAILED DESCRIPTION

Described herein are systems and methods for a rocker based bleeder engine brake. In some embodiments, the described systems are utilized for bleeder type engine braking in type III & V valvetrain systems having two valves per cylinder. However, it will be appreciated that the systems described herein are not limited to such and may be utilized with various other valvetrain systems and components. In one example, the bleeder braking is achieved by assembling a bleeder brake capsule and associated push pin assembly into a rocker arm assembly. The bleeder brake can work entirely based off back pressure inside an exhaust manifold. The described system enables a secondary braking system (e.g., bleeder engine brake) to help control the speed of a vehicle without using the service brake.

During bleeder engine braking, in addition to the main exhaust valve event, one or more exhaust valves are held open throughout the remaining engine cycles (i.e., the intake, compression, and expansion cycles) for a full-cycle bleeder brake or during a portion of the remaining cycles (e.g., the compression and expansion cycles) for a partial-cycle bleeder brake.

In one example operation, the engine brake is activated by (i) generating back pressure inside the exhaust manifold by closing butterfly valve or variable geometry turbocharger (ii) back pressure, together with low in-cylinder pressure, leads to opening of the exhaust valve momentarily thereby creating lash in the valvetrain, (iii) the bleeder brake capsule will expand (pump-up) and compensate for lash, and the pumped-up capsule remains open until the next cycle, and (iv) the bleeder brake capsule is reset during the exhaust vent by the push pin assembly.

Figure 2:
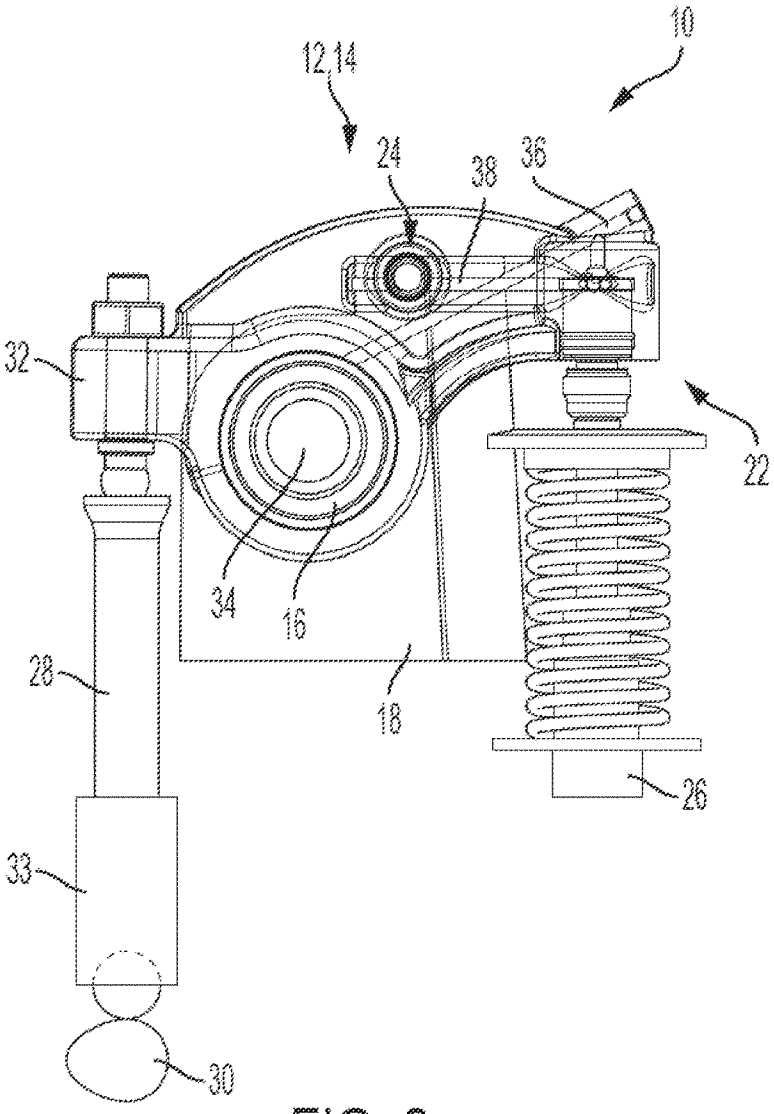
FIG. 2 is a side view of the valvetrain assembly shown in FIG. 1.
Figure 1:
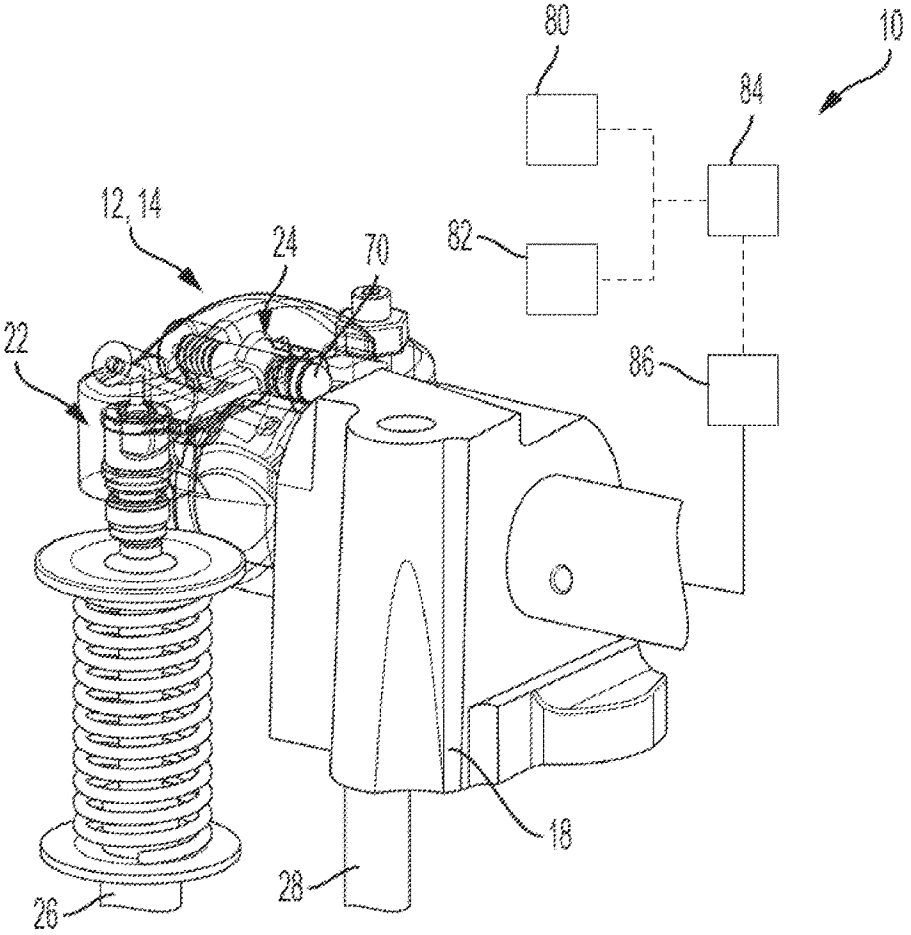
FIG. 1 is a perspective view of a valvetrain assembly constructed in accordance to one example of the present disclosure.

With initial reference to FIGS. 1 and 2, a partial valvetrain assembly constructed in accordance to one example of the present disclosure is shown and generally identified at reference 10. The partial valvetrain assembly 10 utilizes engine braking and can include a rocker arm assembly 12 having a series of intake valve rocker arm assemblies (not specifically shown) and a series of exhaust valve rocker arm assemblies 14. A rocker shaft 16 is received by a fixed rocker housing 18, and the exhaust valve rocker arm assemblies 14 are configured for rotation about the rocker shaft 16. As will become appreciated from the following discussion, the rocker shaft 16 cooperates with the rocker arm assembly 12, and more specifically with the exhaust valve rocker arm assemblies 14, to communicate oil to the exhaust valve rocker arm assemblies 14 during engine braking.

Figure 3:
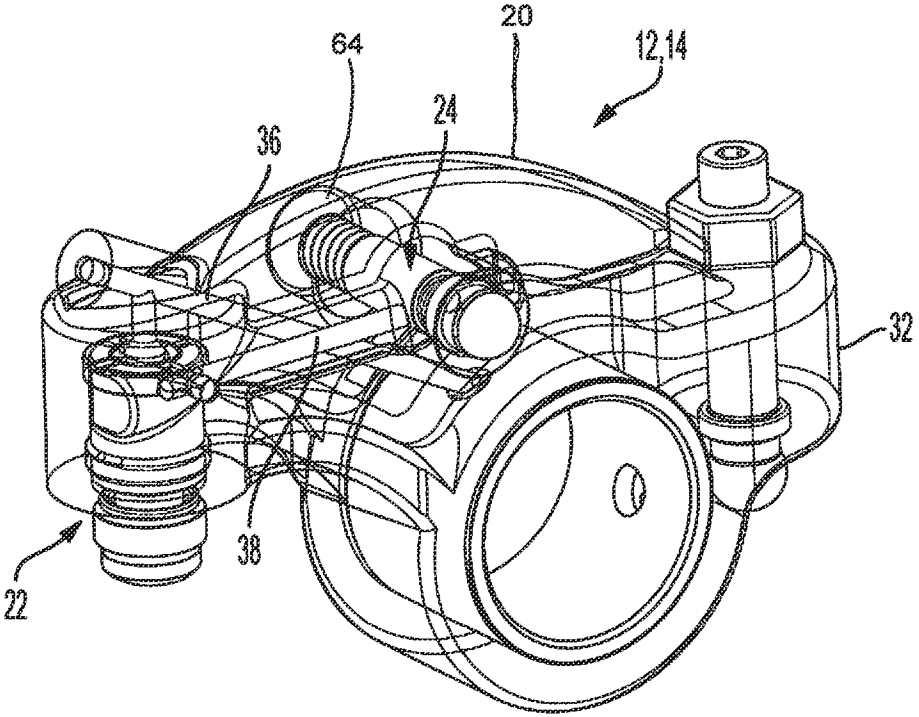
FIG. 3 is a perspective view of the rocker arm assembly shown in FIG. 1.

With additional reference now to FIG. 3, the exhaust valve rocker arm assembly 14 can generally include a rocker arm 20, an engine brake capsule 22 (e.g., bleeder brake capsule), and a reset pin assembly 24.

As shown in FIGS. 1 and 2, in the example embodiment, the rocker arm 20 includes the engine brake capsule 22, which is configured to engage an engine valve 26 associated with a cylinder of an engine (not shown). A pushrod 28 moves upward and downward based on a lift profile of a camshaft 30, and the upward movement of the pushrod 28 is configured to push an arm 32 fixed to the rocker arm 20. This causes the rocker arm 20 to rotate about the rocker shaft 16 such that engine brake capsule 22 can selectively engage and open the engine valve 26. In one example, a hydraulic lash adjuster (HLA) lifter 33 can be implemented between camshaft 30 and the pushrod 28. However, it will be appreciated that the system may not include HLA lifter 33.

In the example embodiment, the rocker shaft 16 can define a pressurized oil supply conduit 34 (FIG. 2), and the rocker arm 20 can define a rocker arm supply conduit 36 that is configured to deliver oil from the pressurized oil supply conduit 34 of the rocker shaft 16 to the engine brake capsule 22. The rocker arm 20 can further define an outlet conduit 38 configured to selectively drain oil from the engine brake capsule 22 by utilizing the reset pin assembly 24, as described herein in more detail.

Figure 4:
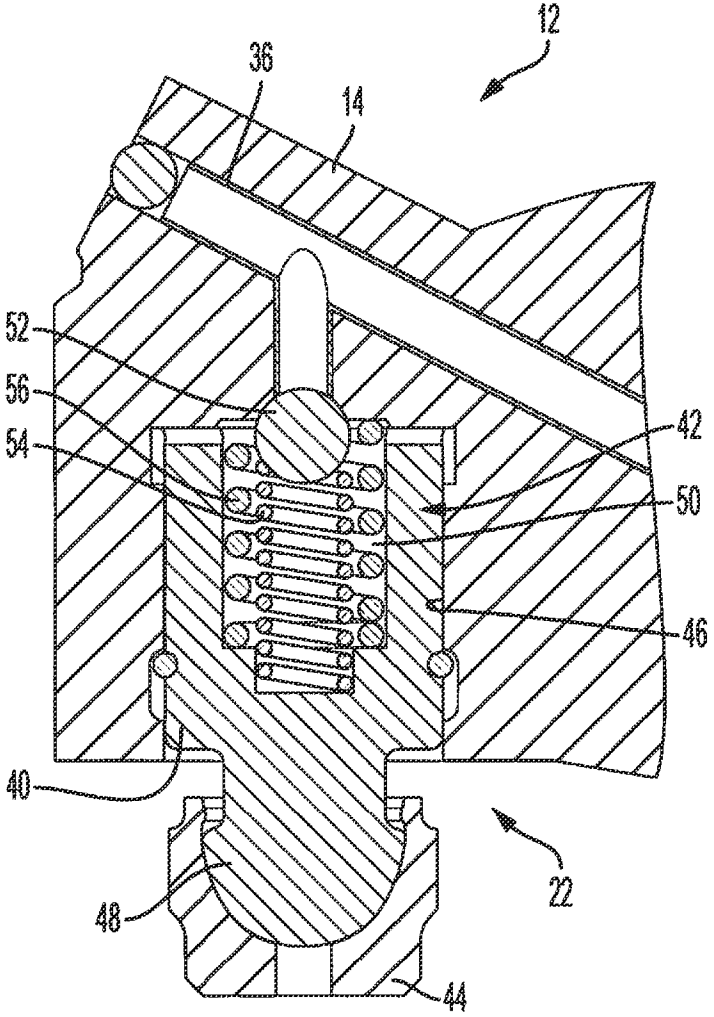
FIG. 4 is a cross-sectional view of an example bleeder brake capsule installed in the rocker arm assembly shown in FIG. 1.

With reference now to FIG. 4, the engine brake capsule 22 will be described in more detail. In the example embodiment, engine brake capsule 22 generally includes a plunger 40, a check ball assembly 42, and an e-foot 44. Plunger 40 is slidingly disposed within a bore 46 formed in rocker arm 20 and defines a spigot 48 and an inner cavity 50. The spigot 48 is pivotably received within e-foot 44, and inner cavity 50 is configured to receive check ball assembly 42.

In the example embodiment, check ball assembly 42 includes a check ball 52, a first biasing mechanism 54 (e.g., a spring), and a second biasing mechanism 56. As shown in FIG. 4, the first biasing mechanism 54 is configured to bias check ball 52 toward supply conduit 36 for sealing thereof, and the second biasing mechanism 56 is configured to bias plunger 40 into a retracted position within bore 46. Supplying pressurized fluid (e.g., oil) through supply conduit 36 is configured to move the plunger 40 from the retracted position (FIG. 4) to an extended position (FIG. 5) to pump-up the engine brake capsule 22, thereby partially opening engine valve 26 to perform a bleeder brake operation.

Figure 6:
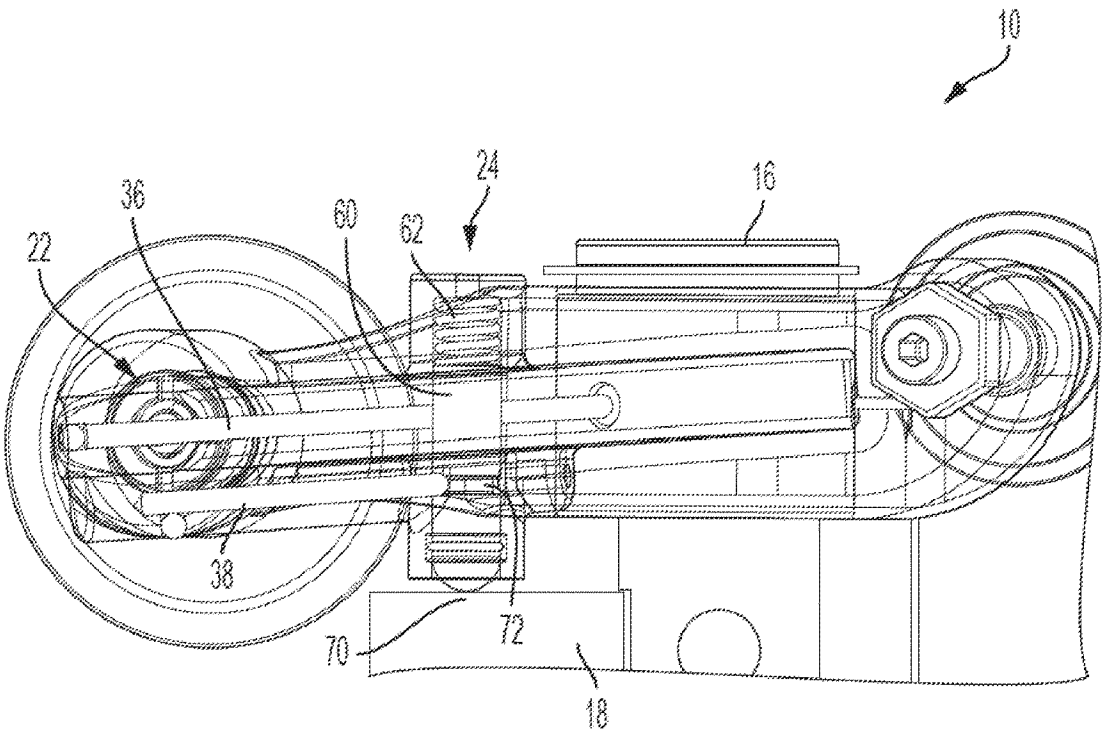
FIG. 6 is a top view of the reset pin assembly shown in FIG. 5, shown in an open position.
Figure 5:
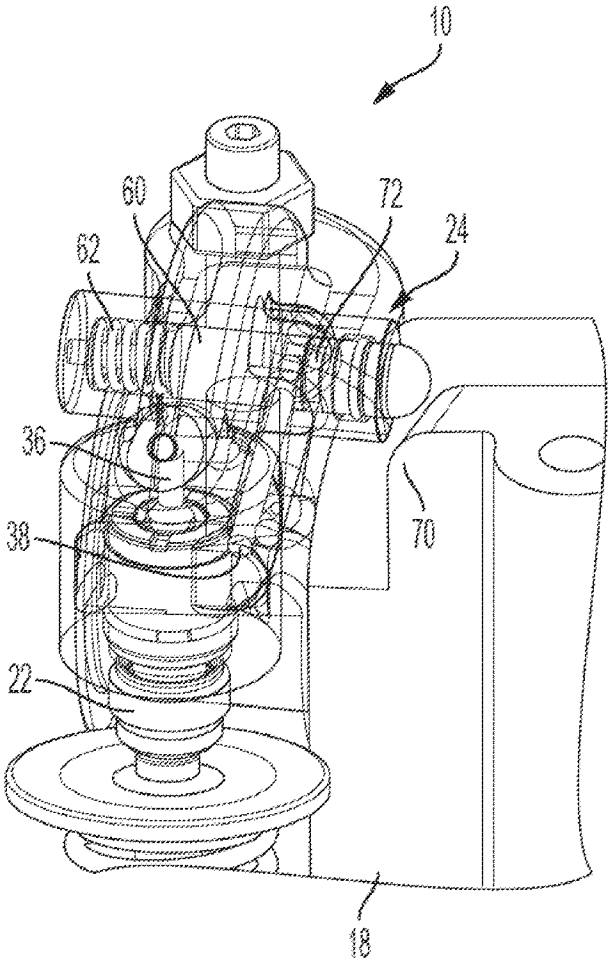
FIG. 5 is a perspective view of an example reset pin assembly of the rocker arm assembly shown in FIG. 1, in a closed position.

With reference now to FIGS. 5 and 6, the reset pin assembly 24 will be described in more detail. In the example embodiment, the reset pin assembly 24 generally includes a pin 60 and a biasing mechanism 62 (e.g., a spring) slidingly disposed within a transverse bore 64 formed in rocker arm 20. Biasing mechanism 62 is configured to bias pin 60 into a closed position (FIG. 5) such that pin 60 acts as a spool valve and blocks oil outlet conduit 38 when pushrod 28 or the HLA lifter 33 is on a base circle of camshaft 30 and engine brake capsule 22 is in the extended position.

At a predetermined time (e.g., during an exhaust lift event) a fixed bump or shoulder 70 formed on the pedestal or rocker housing 18 engages pin 60. This engagement causes movement of pin 60 into bore 64 such that a recess or channel 72 formed in the body of pin 60 aligns with oil outlet conduit 38, thereby allowing oil to leak out of engine brake capsule 22.

Figure 7:
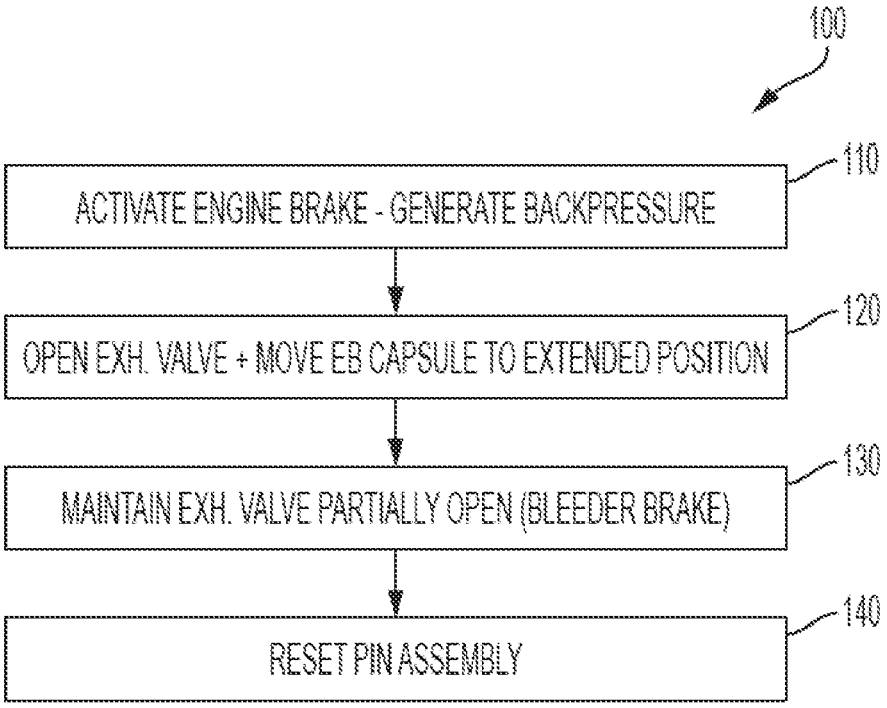
FIG. 7 is a flow diagram of an example method of operating the valvetrain assembly shown in FIG. 1.

FIG. 7 illustrates an example method 100 of operating valvetrain assembly 10. At a first step 110, engine braking is activated by closing a butterfly valve 80 or variable geometry turbocharger (VGT) 82 (see FIG. 1), which generates backpressure inside the exhaust manifold (not shown). In some embodiments, the butterfly valve 80 is located within the exhaust manifold and the magnitude of backpressure that is generated upstream of the exhaust manifold is dependent on the orientation of the butterfly valve 80 between fully open and fully closed. When the butterfly valve 80 is completely closed, maximum backpressure is generated. On the other hand, there is no additional backpressure inside the exhaust manifold when the butterfly valve 80 is completely open. Orientation or position of the butterfly valve 80 can be controlled by a controller 84 such as an engine control unit (ECU). Similarly, controller 84 can be utilized to generate backpressure utilizing the VGT 82 by resisting the flow of exhaust through its turbine.

At a second step 120, the generated backpressure, along with low in-cylinder pressure, reopens exhaust valve 26, thereby creating lash. Pressurized fluid is subsequently supplied through supply conduit 36 into the bore 46, thereby expanding engine brake capsule 22 to move from the retracted position to the extended position, which compensates for lash within the valvetrain 10.

In a third step 130, the pumped-up (extended) engine brake capsule 22 maintains exhaust valve 26 partially open for a predetermined period of time to perform the bleeder brake operation. At a fourth step 140, the reset pin assembly 24 is engaged by shoulder 70 at a predetermined time (e.g., during the exhaust lift event), thereby causing the spool valve to open and drain fluid from the engine brake capsule 22 for resetting thereof.

Figure 8:
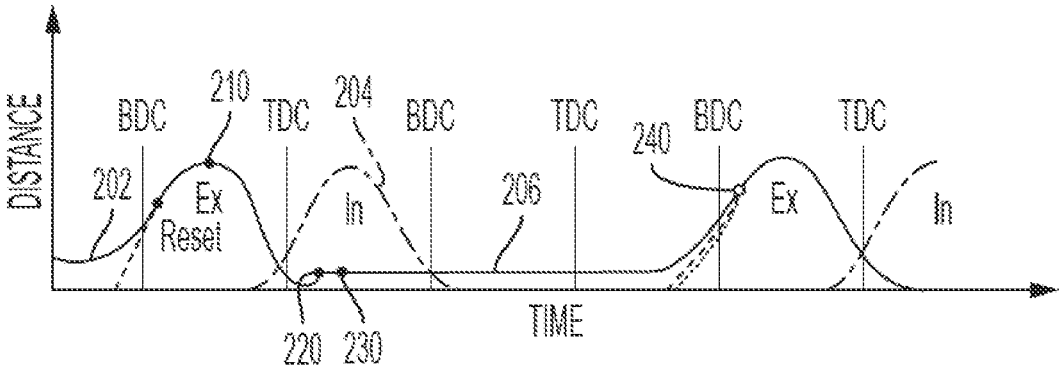
FIG. 8 is a graph illustrating an example valve lift profile of the valvetrain assembly shown in FIG. 1.

FIG. 8 shows a graph 200 illustrating an example valve lift profile during the operation of method 100. Line 202 illustrates motion of exhaust valve 26, and line 204 illustrates motion of an associated intake valve (not shown). Point 210 represents step 110 where the engine braking mode is activated (e.g., via a controller 84 and/or oil control valve 86) and backpressure is generated inside the exhaust manifold, for example, via closing the butterfly valve 80 or the VGT 82, for example with the controller 84 (FIG. 1). Point 220 represents step 120 where the backpressure and low in-cylinder pressure reopen exhaust valve 26 to create lash, and the engine brake capsule 22 is expanded to compensate for lash within the valvetrain.

Point 230 represents step 130 where the engine brake capsule 22 is expanded by the supply of high pressure oil from the rocker shaft supply conduit 34 through the rocker arm supply conduit 36. The expanded engine brake capsule 22 thus keeps exhaust valve 26 opened a predetermined distance to perform an engine braking operation, shown by line 206. Point 240 represents step 140 where the pin 60 engages the rocker housing shoulder 70, thereby resetting the engine brake capsule 22 by causing the spool valve to open and drain fluid therefrom.

Described herein are systems and methods for performing engine braking operations (e.g., bleeder braking) for various valvetrain systems such as, for example, Type III and Type V valvetrain systems having two valves per cylinder. The systems include a rocker arm having an engine brake capsule that is selectively expanded by a supply of high pressure oil to thereby hold an exhaust valve open a predetermined distance to perform the engine braking along with back pressure inside the exhaust manifold. A push pin assembly resets the engine brake capsule when the push pin engages a pedestal of the valvetrain assembly.

As used herein, the term controller refers to an application specific integrated circuit (ASIC), an electronic circuit, a processor (shared, dedicated, or group) and memory that executes one or more software or firmware programs, a combinational logic circuit, and/or other suitable components that provide the described functionality.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. An exhaust valve rocker arm assembly operable in an engine braking mode, the exhaust valve rocker arm assembly comprising:

a rocker arm configured to rotate about a rocker shaft defining a pressurized fluid supply conduit, the rocker arm having a fluid supply passage defined therein;

an engine brake capsule disposed in the rocker arm and in fluid communication with the fluid supply passage, the engine brake capsule configured to selectively move from a retracted position to an extended position where the engine brake capsule engages and partially opens an exhaust valve to perform a bleeder brake operation;

a transverse bore formed in the rocker arm and extending transversely across a body of the rocker arm;

a reset pin assembly configured to selectively drain fluid from and reset the engine brake capsule, the reset pin assembly including a reset pin slidingly disposed within the transverse bore; and a fixed shoulder formed on a fixed rocker housing, the fixed shoulder configured to be selectively engaged by the reset pin assembly when the rocker arm rotates downward toward the exhaust valve during a main exhaust event, to thereby actuate the reset pin assembly and facilitate draining the fluid from the engine brake capsule.

2. The exhaust valve rocker arm assembly of claim 1, wherein the engine brake capsule is disposed in a capsule bore formed within the rocker arm, wherein the transverse bore extends along an axis generally perpendicular to an axis of extension of the capsule bore.

3. The exhaust valve rocker arm assembly of claim 2, wherein the reset pin assembly further includes a biasing mechanism configured to bias the reset pin into a closed position such that the reset pin acts as a spool valve and blocks a fluid outlet conduit formed in the rocker arm.

4. The exhaust valve rocker arm assembly of claim 1, wherein the reset pin is arranged entirely outside of the fluid supply passage that extends between the fluid supply conduit and the engine brake capsule.

5. The exhaust valve rocker arm assembly of claim 1, wherein the rocker arm further includes a fluid outlet conduit in fluid communication with the engine brake capsule, the fluid outlet conduit configured to drain the fluid from the engine brake capsule via the reset pin assembly.

6. The exhaust valve rocker arm assembly of claim 1, wherein the engine brake capsule includes a plunger slidingly disposed within the rocker arm.

7. The exhaust valve rocker arm assembly of claim 1, wherein the engine brake capsule includes a check ball assembly comprising a check ball, a first biasing mechanism configured to bias the check ball into a sealing position to seal the fluid supply passage, and a second biasing mechanism configured to bias a plunger into a retracted position within a bore defined in the rocker arm.

8. The exhaust valve rocker arm assembly of claim 1, wherein the rocker arm further includes an outlet conduit having a first end fluidly coupled to the engine brake capsule, and an opposite second end configured to drain the fluid from the rocker arm, wherein the outlet conduit is a straight passage between the first and second ends.

9. The exhaust valve rocker arm assembly of claim 1, further comprising a controller configured to generate a backpressure inside an exhaust manifold to reopen the exhaust valve.

10. The exhaust valve rocker arm assembly of claim 9, wherein the controller is configured to generate the backpressure by closing at least one of a butterfly valve and a variable geometry turbocharger.

11. A valvetrain assembly comprising:

a rocker housing including a fixed shoulder fixed to the rocker housing;

a rocker shaft received within the rocker housing;

a rocker arm assembly configured to rotate about the rocker shaft; and a pushrod configured to selectively engage and rotate the rocker arm assembly about the rocker shaft to engage and open an exhaust valve, wherein the rocker arm assembly comprises:

a rocker arm having a fluid supply passage defined therein;

an engine brake capsule disposed in the rocker arm and in fluid communication with the fluid supply passage, the engine brake capsule configured to selectively move from a retracted position to an extended position where the engine brake capsule engages and partially opens the exhaust valve to perform a bleeder brake operation; and a reset pin assembly configured to selectively engage the fixed shoulder when the rocker arm rotates downward toward the exhaust valve during a main exhaust event to thereby drain fluid from and reset the engine brake capsule.

12. The valvetrain assembly of claim 11, further comprising:

a camshaft having a lift profile configured to engage and cause upward movement of the pushrod; and a hydraulic lash adjuster lifter implemented between the camshaft and the pushrod.

13. The valvetrain assembly of claim 11, wherein the rocker arm further includes a fluid outlet conduit in fluid communication with the engine brake capsule, the fluid outlet conduit configured to drain the fluid from the engine brake capsule via the reset pin assembly.

14. The valvetrain assembly of claim 11, wherein the reset pin assembly comprises:

a reset pin slidingly disposed within a transverse bore formed in the rocker arm; and a biasing mechanism configured to bias the reset pin into a closed position such that the reset pin acts as a spool valve and blocks a fluid outlet conduit formed in the rocker arm.

15. The valvetrain assembly of claim 11, wherein the engine brake capsule comprises:

a plunger slidingly disposed within the rocker arm; and a check ball assembly having a check ball, a first biasing mechanism configured to bias the check ball into a sealing position to seal the fluid supply passage, and a second biasing mechanism configured to bias a plunger into a retracted position within a bore defined in the rocker arm.

16. A method of operating a valvetrain assembly having an exhaust rocker arm assembly comprising a rocker arm configured to rotate about a rocker shaft defining a pressurized fluid supply conduit, the rocker arm having a fluid supply passage defined therein, an engine brake capsule disposed in the rocker arm and in fluid communication with the fluid supply passage, the engine brake capsule configured to selectively move from a retracted position to an extended position where the engine brake capsule engages and partially opens an exhaust valve to perform a bleeder brake operation, and a reset pin assembly configured to selectively drain fluid from the engine brake capsule, the method comprising:

activating an engine braking mode by closing one of a butterfly valve and a variable geometry turbocharger to generate backpressure inside an exhaust manifold;

opening the exhaust valve with the generated backpressure along with in-cylinder pressure to momentarily create lash;

supplying pressurized fluid via the fluid supply conduit and the fluid supply passage to the engine brake capsule to thereby expand the engine brake capsule into the extended position to compensate for the lash and hold the exhaust valve open;

maintaining the exhaust valve partially open for a predetermined time via the engine brake capsule in the extended position; and when the rocker arm rocks downward toward the exhaust valve in response to a camshaft lift profile, engaging the reset pin assembly with a fixed shoulder of a fixed rocker housing to thereby drain fluid from the engine brake capsule and reset the engine brake capsule to the retracted position.

17. The method of claim 16, wherein said maintaining the exhaust valve partially open comprises performing a full-cycle bleeder brake operation.

18. The method of claim 16, wherein said resetting the engine brake capsule to the retracted position is performed during an exhaust stroke after bottom dead center (BDC) and prior to a next occurring top dead center (TDC).

* * * * *